US009911560B2

(12) United States Patent
Lell

(10) Patent No.: US 9,911,560 B2
(45) Date of Patent: Mar. 6, 2018

(54) ELECTRICAL INTERRUPTION SWITCH, IN PARTICULAR FOR INTERRUPTING HIGH CURRENTS AT HIGH VOLTAGES

(71) Applicant: Peter Lell, Moosburg (DE)

(72) Inventor: Peter Lell, Moosburg (DE)

( * ) Notice: Subject to any disclaimer, the term of this patent is extended or adjusted under 35 U.S.C. 154(b) by 0 days.

(21) Appl. No.: 15/315,456

(22) PCT Filed: Jun. 2, 2015

(86) PCT No.: PCT/DE2015/100218
§ 371 (c)(1),
(2) Date: Dec. 1, 2016

(87) PCT Pub. No.: WO2015/185038
PCT Pub. Date: Dec. 10, 2015

(65) Prior Publication Data

US 2017/0213676 A1 Jul. 27, 2017

(30) Foreign Application Priority Data

Jun. 4, 2014 (DE) ..... 10 2014 107 853

(51) Int. Cl.
*H01H 39/00* (2006.01)

(52) U.S. Cl.
CPC ..... *H01H 39/006* (2013.01); *H01H 2039/008* (2013.01)

(58) Field of Classification Search
CPC ..... H01H 39/006; H01H 2039/008; H01H 33/70; H01H 33/30
USPC ..... 218/158, 95, 155; 337/157, 30
See application file for complete search history.

(56) References Cited

U.S. PATENT DOCUMENTS 3,848,100 A 11/1974 Kozorezov et al.
4,342,978 A * 8/1982 Meister ..... H01H 9/106 337/6
4,345,127 A 8/1982 Niemeyer
6,107,590 A * 8/2000 Skindhoj ..... H01H 39/00 218/1

(Continued)

FOREIGN PATENT DOCUMENTS

DE 2103565 8/1971
DE 2904207 7/1980

(Continued)

*Primary Examiner* — Truc Nguyen
*Assistant Examiner* — William Bolton
(74) *Attorney, Agent, or Firm* — The Webb Law Firm

(57) ABSTRACT

An electrical interruption switch having a casing which surrounds a contact unit which defines the path of the current through the interruption switch, and having a propellant charge having a gas-generating activatable material. The contact unit has a first and a second connection contacts, an upsetting region, a separation region and a sabot. An extinguishing agent is provided in such a way that the motion of the sabot and/or the upsetting of the upsetting region reduces the volume for receiving the extinguishing agent in such a way that the extinguishing agent is injected through at least one discharge channel that connects the volume for receiving the extinguishing agent to the chamber in which the separation region is located, in order to extinguish or to prevent the formation of an electric arc between the ends of the separation region.

19 Claims, 8 Drawing Sheets

(56) References Cited

U.S. PATENT DOCUMENTS

| | | | | |
|---|---|---|---|---|
| 6,385,026 | B1 * | 5/2002 | Yamaguchi | H01H 39/00 361/103 |
| 6,954,132 | B2 * | 10/2005 | Lell | H01H 39/006 337/30 |
| 7,557,688 | B2 * | 7/2009 | Von Behr | B23D 15/145 337/157 |
| 2004/0021306 | A1 | 2/2004 | Lell | |
| 2013/0175144 | A1 | 7/2013 | Sprenger et al. | |

FOREIGN PATENT DOCUMENTS

| | | | |
|---|---|---|---|
| DE | 19749133 | A1 | 5/1999 |
| DE | 19749135 | A1 | 7/1999 |
| DE | 10028168 | A1 | 12/2001 |
| DE | 10205369 | A1 | 8/2003 |
| DE | 102010035684 | A1 | 3/2012 |
| GB | 1307486 | | 2/1973 |

* cited by examiner

ELECTRICAL INTERRUPTION SWITCH, IN PARTICULAR FOR INTERRUPTING HIGH CURRENTS AT HIGH VOLTAGES

CROSS-REFERENCE TO RELATED APPLICATIONS

This application is the United States national phase of International Application No. PCT/DE2015/100218 filed Jun. 2, 2015, and claims priority to Korean Patent Application No. 10 2014 107 853.5 filed Jun. 4, 2014, the disclosures of which are hereby incorporated in their entirety by reference.

BACKGROUND OF THE INVENTION

Field of the Invention

The invention relates to an electrical interruption switch, in particular for interrupting high currents at high voltages.

Description of Related Art

Such switches are used for instance in power plant and motor vehicle technology for the defined, fast disconnection of high-current electrical circuits in an emergency. There is a need for a switch of this kind in which its tripping and interruption function must be reliably ensured even without maintenance, even for as long as up to 20 years. Moreover, no additional potential danger from hot gas, particles, ejected pieces, plasma, or high voltages induced in the circuit that has been shut off must originate in such a switch.

One possible area of application in motor vehicle technology is the defined, irreversible disconnection of the on-board wiring from the car battery or drive battery shortly after an accident, for the sake of avoiding ignition sources from sparks and plasma that occur for instance if cable insulations are sheared off by sheet-metal parts of the vehicle body penetrating during the accident, or if loose cable ends press against one another or against sheet-metal parts and are sheared off. If gasoline also escapes in an accident, such ignition sources can ignite ignitable mixtures of gasoline and air that accumulate under the hood of the engine, for instance. Additional areas of application are the electrical disconnection of a component assembly from the on-board electrical system in the event of a short circuit in that component assembly, such as a separate electric heater or electric brake, and an emergency shutoff of a lithium battery of the kind used today in electrical and hybrid vehicles as well as in aircraft. These batteries, with a small structural volume, have a high terminal voltage of up to 1200 V with extremely low internal resistance. Both factors can potentially cause a short-circuit current of up 5000 A, without a major drop in the source voltage. For an emergency shutoff of individual solar cell modules or entire large-scale solar cell installations if necessary, the interruption switch presented here is highly suitable because it can be embodied to be triggerable or remote-controllable. Furthermore, it can be embodied such that, in addition or instead, it trips passively, that is, like a conventional safety fuse.

Pyrotechnical fuses that are triggered actively for tripping are known in the prior art. For instance, DE 2 103 565 describes a current interrupter which includes a metal casing that is connected, at two terminal regions spaced apart from one another, in each case to an end of a conductor that is to be made safe. The current path extends via the casing. A pyrotechnical element that is formed by an explosive charge is provided in the casing. The explosive charge is activatable by an electrical igniter, which includes an ignition element that is vaporized by a feed current. The casing is filled with an insulating fluid. The axially elongated casing has an encompassing groove along which the casing tears if the explosive charge is ignited. The casing is then broken apart into two parts that are electrically separate from one another, so that the applicable current circuit is cut. The plasma generated when a current circuit with very high current intensity is cut is extinguished in this current interrupter by the atomized insulating fluid. The tripping can be effected in a motor vehicle by means of the signal of a shock sensor, for instance.

Because the entire sheath would have to be heated up to the tripping temperature and then a detonation-type reaction would not be achieved for certain, self-tripping for disconnecting the current circuit if the conductor to be secured is overloaded is not provided in this known device. This is because it is difficult to ignite an explosive, or in other words to cause it to react by detonating, simply by heating the sheath. However, in the casing form described in DE 2 103 565, for example, this kind of ignition or detonation would be necessary.

It should be mentioned that in pyrotechnics, the term "detonative reaction" is used worldwide if flame-front speeds that by definition are higher than 2000 m/s are reached.

A further disadvantage of this known device is the problem of obtaining permits for devices that have component assemblies filled with explosives or even detonators. For that reason, such devices have so far not come to be used commercially. They are employed only very rarely, in research institutes for special experiments. This is also due to their very poor handling safety and their extremely great potential danger, which can be kept within bounds only with great difficulty.

In many cases, there is also a need for a self-tripping function of such a switch or fuse device, for instance in order, without additional expense for overload sensors, to protect a cable against overload or in the event of a failure of the tripping sensor system or tripping circuit. Such a switch should therefore not only be capable of being tripped controllably but should also have the function of a conventional high-current safety fuse, in the form of a safety fuse that anyone can handle safely, as is the case with conventional safety fuses.

High-current safety fuses of this kind have the disadvantage of a shutoff time which fluctuates within a wide bandwidth after the rated amperage of the fuse has been reached. A cable thus protected can therefore be tasked with only a very slight proportion, such as 30%, of its current-carrying capacity, as otherwise a cable fire, for example, can occur in the event of an overload.

From DE 197 49 133 A1, an emergency shutoff switch for electrical circuits is known that makes both self-tripping and triggerable tripping possible. To that end, an electrical conductor is used which has a pyrotechnical core. This core can for instance comprise a charge of propellant powder. The pyrotechnical core can be ignited on the one hand by heating of the electrical conductor if a permissible current intensity (rated current intensity) is exceeded. On the other, provision is made such that the pyrotechnical core is ignited by a triggerable ignition device, for instance in the form of a glow wire. DE 197 49 133 A1, however, merely describes the principle of such a device but gives no clues whatever about possible embodiments that could advantageously be feasibly constructed. This is because producing a conductor with this kind of pyrotechnical core entails considerable effort and expense. Furthermore, even in this kind of emergency shutoff switch, secure, fast disconnection of the conductor can be ensured only if a detonative explosive substance is employed. In deflagrating substances, that is, substances that cannot be made to react detonatively, such as thermite or nitrocellulose powder, all that happens is that the conductor bursts, and the remaining gas escapes without the conductor being completely disconnected. Complete disconnection is then at best achieved by the complete melting of the conductor as a consequence of the current flowing via the fuse. However, at higher voltages, in particular at switching voltages of merely more than 100 V, this would necessarily lead to ion generation and thus plasma formation in the fuse and hence would highly likely prevent the interruption of the circuit.

From DE 100 28 168 A1 of the present applicant, an electrical switch, in particular for switching high currents, is known that can be embodied both actively, that is, by means of a triggerable ignition device, and passively, that is, via the amperage of the current to be switched off. The switch has a casing which includes a contact unit; the contact unit has two connection contacts connected in stationary fashion to the casing or embodied in one piece with it, for supplying and carrying away an electrical current to be switched, and the two connection contacts, in the starting state of the switch, are electrically conductively connected inside the casing. In the casing, an activatable material is provided, which after the activation generates a gas pressure for imposition on the contact unit, wherein the electrically conductive connection is disconnected by exposure to the gas pressure. The contact unit includes a contact element that is movable relative to the stationary connection contacts by being subjected to the gas pressure generated and that, as a result of the subjection to the gas pressure generated, is moved in the direction of the axis of the contact unit from its starting position to an end position, in which the electrical connection is interrupted via the contact unit.

This switch is designed such that there is no movement to the outside whatever of any parts. Moreover, in an activation, no dangerous gases or fragments whatever escape to the outside.

However, it has been found that this switch unit is only limitedly suitable for switching off relatively high voltages, since then there is the danger that an electric arc is created by the interruption of the separation region as a consequence of the outward motion of the torn-apart ends of the separation region. Experiments on using an extinguishing agent which, in the starting state before activation, surrounds the separation region have shown that the desired success is not achieved thereby; that is, the occurrence of an electric arc is not avoided, or an already-existing electric arc is not reliably extinguished.

Based on this prior art, it is an object of the invention to create a pyrotechnical interruption switch, in particular for interrupting high currents at high voltages, in which the shutoff of high currents at high voltages is also securely ensured by avoiding a current maintained by an electric arc. Moreover, a switch is to be created which in terms of safety is completely unobjectionable and can be produced in a simple and economical way.

SUMMARY OF THE INVENTION

In the electrical interruption switch of the invention, as in the switch of DE 100 28 168 A1 of the present applicant, for performing the switching operation an activatable material can be used which generates only a sufficiently high gas pressure, without the requirement, as in a detonative reaction, to generate detonation shock waves, which for safety reasons are unacceptable both in the production of the switch and in its handling.

The electrical interruption switch of the invention has a casing, which surrounds a contact unit defining the current path through the interruption switch. A propellant charge is provided, which includes a gas-generating activatable material. The contact unit has a first and second connection contact, an upsetting region, a separation region, and a sabot. The propellant charge and the contact unit are embodied in such a way that a current to be interrupted can be supplied thereto via the first connection contact and discharged therefrom via the second connection contact, and such that upon an ignition of the propellant charge, the sabot is subjected to a gas pressure, generated by the gas-generating activatable material, in such a way that the sabot in the casing moves in a movement direction from a starting position to an end position and in the operation the upsetting region is plastically deformed, wherein the separation region is separated completely, and in the end position of the sabot an isolation distance between the separated ends of the separation region is achieved. The insulation distance is selected such that it is sufficient for each voltage to be switched.

According to the invention, an extinguishing agent is provided in such a way that as a result of the motion of the sabot and/or the upsetting operation of the upsetting region, the volume for receiving the extinguishing agent is reduced such that the extinguishing agent is injected through at least one discharge channel that connects the volume for receiving the extinguishing agent to the chamber in which the separation region is located, for extinguishing or preventing the occurrence of an electric arc between the ends of the separation region.

In a design of the invention, the volume for receiving the extinguishing agent can be provided inside the upsetting region. The volume for receiving the extinguishing agent is reduced by the upsetting operation, and the extinguishing agent is injected through the at least one discharge channel into the chamber between the separated ends of the separation region of the contact unit. As a result, an electric arc can be extinguished, or can even be prevented from occurring in the first place.

In an embodiment of the invention, the upsetting region can be designed with regard to the material and geometry such that the wall of the upsetting region is folded, preferably in meandering fashion, as a consequence of the upsetting motion.

To this end, the upsetting region can be embodied hollow-cylindrically and preferably annularly in cross section. The extinguishing agent can thus be introduced in the interior of the hollow cylinder. An annular cross section promotes uniform folding, over the circumference, of the hollow cylinder wall during the upsetting operation. The extinguishing agent can be expelled from the receiving volume without being hindered by pieces of the wall entering the discharge path.

The extinguishing agent can be provided in at least one closed, preferably flexible shell which is inside the upsetting region and which can be destroyed by the upsetting operation. It is not absolutely necessary for the at least one discharge channel to be closed and opened again only in the switching operation. Moreover, the extinguishing agent can be introduced into the receiving volume very easily. It is also possible to use many destructible shells in the form of microbeads, the shell of which is destroyed under the pressure that is generated by the reduction in volume (and if applicable that of the gas generated by the activatable material), so that the extinguishing agent is released.

It is also possible to use a rigid container, such as a glass or plastic container, which may be embodied as glass or plastic tubules, as a destructible shell, wherein a certain region of the glass container is preferably equipped with an intentional breaking point, which can be provided in the vicinity of the discharge channel.

The at least one discharge channel can be embodied in nozzle-like fashion, at least in a region upstream of the discharge opening. As a result, a discharge that is favorable for the extinguishing operation in terms of the direction, cross section and speed of the extinguishing agent to be discharged can be achieved. In particular, the discharge channel can be designed such that the stream of extinguishing agent is aimed at the stationary separated end of the separation region.

However, it is equally possible to introduce the extinguishing agent into a receiving volume located outside the upsetting region, in order then to inject the extinguishing agent as a result of the motion of the sabot through one or more channels in the sabot into the combustion chamber. The channel or channels then have at least one inlet opening for the extinguishing agent, through which the extinguishing agent enters from the receiving volume into the channel or channels, and at least one discharge opening, from which the extinguishing agent is discharged. The at least one discharge opening can also be positioned in such a way, and the course of the applicable channel can be configured in such a way, at least in a sufficiently long region upstream of the discharge opening, that a discharge stream for the extinguishing agent is produced that has the desired parameters such as discharge speed, diameter, direction, etc.

Explosive substances, in particular nitrocellulose powder, which can be made to burn or react by igniters, are suitable as substances in the combustion chamber. However, combustible gases, in particular liquid gases or other fuels together with liquid, solid or gaseous oxidizers, can also be used, which are made to react by igniters, electrical discharges, hot wires, or exploding wires.

In general, the term propellant charge, in the sense of the present specification, is understood such that it covers all substances or mixtures of substances which after activation in any way generate gases or vapors that exert the desired pressure on the sabot.

Any medium that can be expelled in a suitable way from the receiving volume at the applicable pressure is suitable as an extinguishing agent. In particular, it can be embodied as extinguishing fluid, as a gaseous, gel-like, foam-like or even multiphase medium.

The at least one discharge channel can, preferably in the vicinity of the at least one discharge opening, be closed by a membrane that is destructible during the tripping operation of the interruption switch. This is necessary at least whenever the extinguishing agent is of such a nature that in the initial state of the switch it is already capable of escaping from the receiving volume.

In one embodiment of the invention, the one or more discharge channels are provided in the sabot in such a way that the one or more discharge openings of the discharge channels are embodied in the vicinity of the cross section of a separation region that at least in the unseparated state adjoins the sabot. As a result, the extinguishing agent is discharged from the part of the contact unit that is moved during the tripping operation, inside the cross section where an electric arc can develop; as a result, the arc can be reliably extinguished, or even prevented from occurring in the first place.

The contact unit can have a rectilinear longitudinal axis, along which the sabot is displaceable. The separation region can then be provided lying adjacent to the sabot and in the longitudinal axis, and a discharge opening can then be located in the longitudinal axis. Thus an extinguishing stream of the extinguishing agent can be generated which is located precisely in the axis in which an electric arc is most likely to develop.

However, switches are also conceivable in which the sabot of the contact unit can move in a more or less curved casing, so that switches can be fabricated in which both current connections are at an angle between 1° and 360°, preferably at an angle of 45°, 90° or 180°. Thus, given a casing curved by 180°, after tripping and after the breaking open of the strut region, the sabot would move in a semicircle in the casing, so that both current connections come to rest on the same side.

In one embodiment, the sabot can be embodied in two parts, and a second sabot composed of an insulating material surrounds and acts on a first sabot part that is solidly connected to or embodied in one piece with the contact unit, and the second sabot part is preferably sealed off from the first sabot part and from the casing. This variant makes it possible to use a conductive material, in particular a metal, at least for the inner wall of the casing, as a result of which, because of the strength of the metal, a structurally small realization of the switch is possible.

The separation region and the propellant charge are embodied such that the separation region, upon an ignition of the propellant charge, is ruptured, or at least partially ruptured, and is completely separated by means of a displacement motion of the sabot. For instance, the propellant charge can be located at least partially inside the separation region. Upon ignition of the propellant charge, the separation region is ruptured entirely or at least partially along the circumference. If it ruptures partially, the complete disconnection occurs as a result of the displacement motion of both the sabot and the part of the separation region that is still connected after the separation, and as a result the upsetting region is upset.

However, the separation region can also be designed such that, upon an ignition of the propellant charge, two nondestructible separable parts of the separation region are pushed apart by a displacement motion of the sabot.

To create an interruption switch that implements serial multiple interruptions, the contact unit can have at least two partial contact units, which each have an upsetting region, a separation region, and a sabot. The partial contact units can then each be embodied such that upon an ignition of the propellant charge, each sabot is subjected in such a way to a gas pressure generated by the gas-generating activatable material that the applicable sabot in the casing moves in a movement direction from a starting position into an end position and in the operation the associated upsetting region is plastically deformed, and the applicable separation region is completely separated, and in the end position of the applicable separation region, an insulation spacing is achieved between the separated ends of the applicable separation region. The extinguishing agent is provided such that as a result of the motion of one or more sabots or of all the sabots and/or by the upsetting operation of one or more or all of the upsetting regions, the volume for receiving the extinguishing agent is reduced such that in each case the extinguishing agent is injected through one discharge channel that connects the volume for receiving the extinguishing agent to the chamber in which an associated separation region is located, for extinguishing or preventing the occurrence of an electric arc between the ends of the applicable separation region.

This kind of serial multiple interruption has the advantage that during a simultaneously occurring interruption operation, in each case only a proportional voltage is applied between the ends, which are to be separated, of the separation regions, and thus the risk of an electric arc is lessened.

In a preferred embodiment, two partial contact units are provided, the contact units and their casing being embodied mirror-symmetrically relative to a center plane, and the separation regions and the sabots are preferably provided outside the upsetting regions located between them. In addition to the serial separation, this has the advantage that the mechanical movements extend in opposite directions and thus at least largely compensate for one another outward.

The motions of the sabot and the upsetting operations associated with this of the upsetting regions can act on a single common receiving volume for an extinguishing agent wherein, however, discharge channels are provided for each of the partial contact units. The common volume for receiving the extinguishing agent can be provided inside the upsetting regions, facing one another, of the partial contact units.

In a design of the invention, each partial contact unit can be assigned a separate partial propellant charge, and a triggerable device can be provided for the active and essentially simultaneous ignition of the separate partial propellant charges. As a result, it can be ensured in a simple way that the advantage of the serially located separation regions, namely the occurrence of only half the voltage at each of the ends of the separation regions during the shutoff operation, can also be utilized.

Externally, the interruption switch of the invention is free of repercussions. No exhaust gases, no light, and no plasma escape; the tripping noise is perceived only as a soft click, and the two electrical connections of the interruption switch can be fixedly fastened, since no motion of one or the other connection is necessary for the function of the switch.

The casing itself can be provided as a tube with lids screwed in or crimped in on both sides, preferably comprising a potlike part into which the lid is screwed in together with the entire contact unit. The casing may also be embodied in one piece if the material comprising it is readily deformable, for instance by crimping or bending. The casing may also be made from multiple parts to form a one-piece casing, for instance by means of adhesive bonding or welding of the individual parts.

An integral arrangement of one or more contact units in an overriding cumulative casing or in an overriding utility component assembly is also possible.

BRIEF DESCRIPTION OF THE DRAWINGS

The invention will be described in further detail below in terms of the embodiments shown in the drawings. In the drawings.

DETAILED DESCRIPTION OF THE INVENTION

Figure 1:
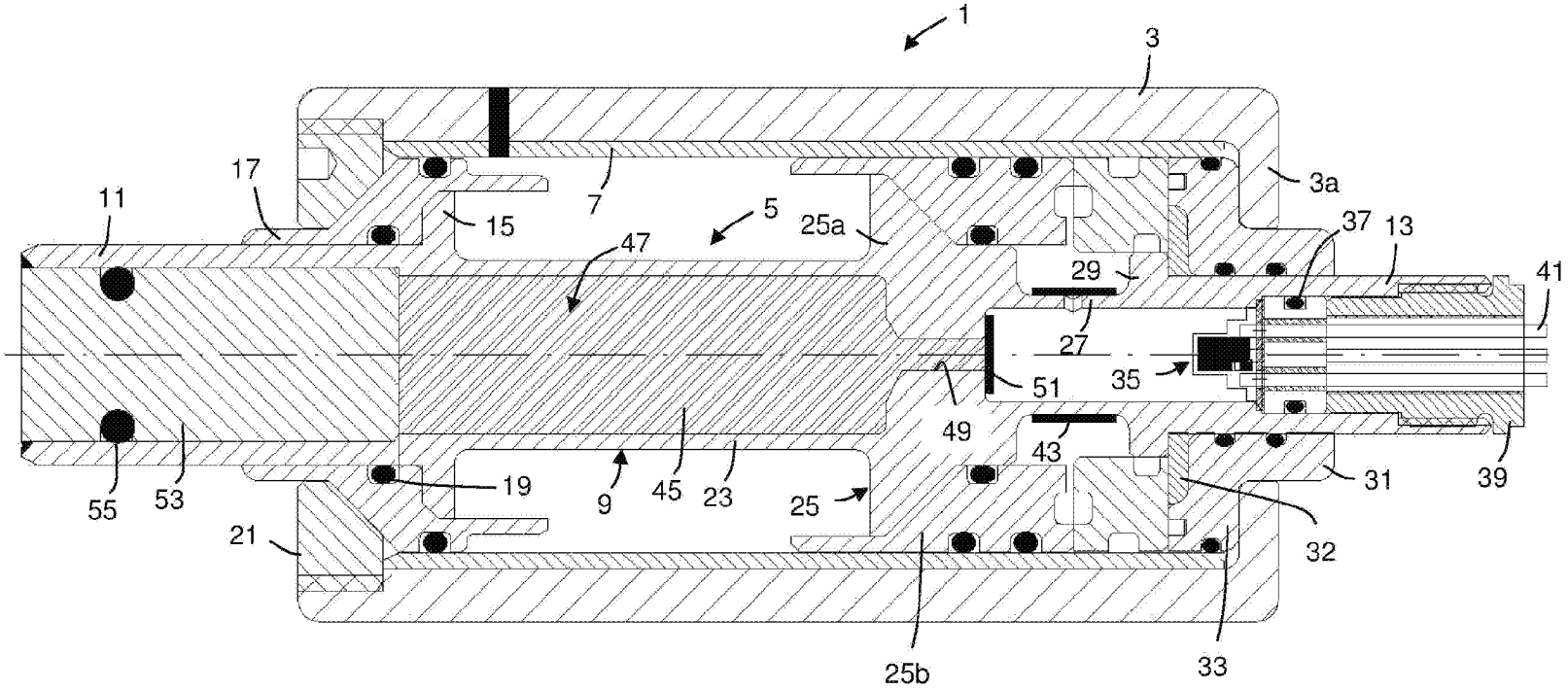
FIG. 1 is a longitudinal section through a first embodiment of an interruption switch of the invention in the initial state.

The first embodiment shown in FIG. 1 of an interruption switch 1 includes a casing 3, in which a contact unit 5 is located. The casing 3 is embodied such that it withstands a pressure, generated inside the casing, which is generated upon a pyrotechnical tripping of the interruption switch 1, without the risk of damage or even bursting. In particular, the casing can be composed of a suitable metal. In that case, an insulation layer 7 can be provided on the inner wall of the casing, the insulation layer being composed of a suitable insulating material, such as a plastic. As a result, at higher voltages, flashovers or an electrical contact between the contact unit 5, which is understood to be composed of a conductive metal, such as copper, and the casing 3 can be avoided, particularly during and after the tripping of the interruption switch 1. For still higher voltages, for instance of greater than 2000 V, the casing can be composed entirely of an insulating material, in particular a suitable plastic. In that case, the wall thickness of the casing 3 will typically be thicker than in the case of a metal casing at lower voltages.

In the exemplary embodiment shown, the contact unit 5 is embodied as a continuous switching tube 9. The switching tube 9 in the exemplary embodiment shown has a first connection contact 11 with a greater diameter and a second connection contact 13 with a lesser diameter. The first connection contact 11 is adjoined by a radially outward-extending flange 15, which is braced on an annular insulator element 17, which comprises an insulating material, such as a plastic, in such a way that the switching tube 9 cannot be moved out of the casing 3 in the axial direction. The insulator element 17 for that purpose has an annular shoulder, on which the flange 15 of the switching tube 9 is braced. In addition, the insulator element 17 insulates the casing from the switching tube 9. The annular insulator element 17, in an axially outer region, has an inside diameter which is essentially equivalent to the outside diameter of the switching tube 9 in the vicinity of the first connection contact 11. As a result, a sealing action is attained, which is reinforced by an additional, annular sealing element 19, such as an O-ring. The insulator element 17 can also be connected to the switching tube 9 via a press fit or injection-molded onto it. The insulator element 17 and thus the switching tube 9 or the contact unit 5 is held in the casing 3 on the applicable face end of the interruption switch 1 by means of a locking nut 21, or fixed in the casing 3 in this way. The locking nut 21 may comprise metal. As a result, it is also ensured that the switching tube, if the plastic parts of the interruption switch 1 soften or burn, cannot escape from the casing even if the interruption switch 1 is still being tripped in this state. This is because the outside diameter of the flange 15 is selected to be greater than the inside diameter of the locking nut 21.

It is understood, however, that the casing 3 can also be remodeled on the face end shown on the left in FIG. 1 during the assembly of the interruption switch 1, in such a way that a radially inward-extending part of the casing fixes the insulator element 17. If the casing is of plastic, then the insulator element 17 can also be omitted.

The switching tube 9 has an upsetting region 23 adjoining the flange 15 in the axis of the switching tube 9. The wall thickness of the switching tube 9 is selected in the upsetting region 23, which has a predetermined axial extent, and is adapted to the material, in such a way that upon tripping of the interruption switch 1 as a consequence of a plastic deformation of the switching tube 9 in the upsetting region 23, the result is shortening of the upsetting region in the axial direction by a predetermined length.

The upsetting region 23 is adjoined in the axial direction of the switching tube 9 by a sabot 25, which in the exemplary embodiment shown is embodied in two parts. A first sabot part 25*a* is embodied in one piece with the switching tube 9 and extends radially outward almost as far as the inner wall of the casing 3. A second sabot part 25*b*, which in the exemplary embodiment shown comprises an insulating material, such as a suitable plastic, surrounds the switching tube with the first sabot part 25*a* in such a way that an insulating region of the second sabot part 25*b* intervenes between the outer circumference of the first sabot part 25*a* and the inner wall of the casing 3. Moreover, the sabot parts 25*a*, 25*b* are embodied such that the second sabot part, upon imposition of pressure or force from the side facing away from the upsetting region 23, transmits the applicable force in the axial direction to the first sabot part 25*a*. This force is selected such that during the tripping operation of the interruption switch 1, upsetting of the upsetting region occurs, whereupon the sabot 25 is moved out of its starting position (status prior to the tripping of the interruption switch 1) into an end position (after the termination of the switching operation).

As can be seen from FIG. 1, the second sabot part can be selected such that its outside diameter is essentially equivalent to the inside diameter of the casing 3, so that axial guidance of the second sabot part 25*b* and thus also an axially guided upsetting motion during the switching operation are achieved.

The second sabot part 25*b* may also have an annular region extending axially as far as inside the upsetting region 23, which annular region cooperates with a corresponding annular region of the insulator element 17 that extends axially into the upsetting region 23 as well. The annular region of the insulator element 17 can define an annular gap between its axial outer wall and the axial inner wall of the casing 3, into which gap the annular region, resting on the inner wall of the casing 3, of the second sabot part 25*b* is moved axially. If the annular gap which defines the annular region of the insulator element 17 is selected as slightly less thick than the thickness of the wall of the annular region of the second sabot part 25*b*, then the result in the tripped state, that is, in the end position of the sabot 25*b* is a secure fixation of the sabot 25.

The sabot 25 of the switching tube 9 or contact unit 5 is adjoined by a separation region 27, which in turn is axially adjacent to a flange 29 of the switching tube 9. The flange 29 is then adjoined by the second connection contact 13 of the switching tube 9. The flange 29 in turn serves to fix the switching tube 9 or contact unit 5 axially securely in the casing 3. This purpose is served by a radially inward-extending annular region 3*a* of the casing 3 and an insulator element 31, which is provided between a corresponding stop face of the flange 29, the inner wall of the face-end annular region 3*a* of the casing 3, and the axial inner wall of the casing 3 and annularly surrounds the second connection contact of the switching tube 9.

In the exemplary embodiment shown, the second sabot part 25*b*, upon assembly of the interruption switch, is thrust from the side of the connection contact 13 onto the switching tube 9 and must therefore be dimensioned such that its inside diameter is greater than or equal to the outside diameter of the flange 29. Since the annular second sabot part 25*b* cannot be made arbitrarily thin, and the insulator element 31 in the vicinity of the axial inner wall of the annular region of the wall 3*a* of the casing 3 must have a predetermined minimum thickness as well, in this exemplary embodiment a metal disk 32 is thrust onto the switching tube 9 as far as the flange 29, which flange has a greater outside diameter than the inside diameter of the annular region 3*a* of the casing 3. The metal disk may comprise titanium, for instance, and in the case of a fire, that is, upon softening or destruction of the insulator element 31, it prevents the switching tube 9 from emerging from the casing 3, even if the interruption switch 1 is tripped in this state.

In the interior of the casing between a face end of the second sabot part 25*b* facing away from the upsetting region 23 and an end wall of the insulator element 31 facing toward the upsetting region 23, an annular filler piece 33 is provided, which has an outside diameter that is essentially equivalent to the inside diameter of the casing 3 and an inside diameter that is essentially equivalent to the outside diameter of the flange 29. The filler piece 33 serves to reduce the volume of the interior between the end face, facing away from the upsetting region 23, of the sabot 25, the inner wall of the casing 3, the insulator element 31, and the outer wall of the separation region 27, in order to make a faster pressure buildup possible.

An ignition device 35 is provided in the axial end of the contact tube 9 in the vicinity of the second connection contact 13. The outer circumference of the ignition device 35 is sealed off from the inner wall of the switching tube 9 or of the second connection contact 13 by a sealing element 37 such as an O-ring. For axial fixation of the ignition device 35, a small shoulder may be provided in the inner wall of the switching tube 9 or of the second connection contact 13, wherein in the assembly of the interruption switch 1, the ignition device is thrust inward into the switching tube 9 as far as the shoulder. For axial fixation of the ignition device 35, a locking element 39 is screwed into the second connection contact 13. Through an opening in the annular locking element 33, the electrical connection lines of the ignition devices 35 can be carried to the outside. For complete sealing and fixation, the interior of the locking element 39 can be potted, in particular with a suitable epoxy resin. The resin then simultaneously serves to relieve strain on the connection lines 41.

The interior of the switching tube 9 in the vicinity of the separation region 27, between the sabot 25 and the ignition device 35, is filled with a propellant charge, for instance in powder form. The propellant charge is activatable by the ignition device 35 and upon activation generates a gas which fills the interior inside the separation region 27.

The separation region is dimensioned such that as a result of the generated gas pressure, it at least partially tears open so that the gas penetrates into the surrounding annular chamber and into the gap between the sabot 25 and the filler piece 33 as well. To make for easier rupturing, the wall of the switching tube 9 in the separation region 27 may also have one or more openings. Moreover, propellant charge material may be provided in the annular chamber that surrounds the separation region 27 as well.

The ignition device may comprise a simple, rapidly heatable glow wire. In the immediate vicinity, or applied to the ignition device 35, an ignition mixture or some corresponding material may also be provided.

The activation of the ignition device can be done by means of suitable electrical triggering.

It is understood that the ignition device 35 may, however, also be embodied in any other way that brings about an activation of the propellant charge.

In addition or instead, passive activation of the interruption switch 1 may be provided. To that end, the temperature increase in the material of the switching tube 9 in the separation region 27 is exploited. In this case, the most direct possible contact should exist between the propellant charge and the inner wall and/or outer wall of the switching tube 9 in the separation region 27. In addition, a more easily activatable material, in particular an ignition mixture, can be provided in the immediate vicinity or applied to the inner wall and/or outer wall of the separation region.

FIG. 1 shows one such layer of an ignition mixture 43, which is applied in paste form to the outer wall of the separation region. In this case, a propellant charge should also be provided in the annular chamber that surrounds the separation region 27, if at all possible in direct contact with the ignition mixture 43.

The electrical resistance and thus also the thermal performance of the separation region can be varied by means of providing openings in the wall of the separation region 27 (it is understood that this is in conjunction with the wall thickness of the separation region and the dimensioning of the radii at the transitions of the separation region, which essentially determine the heat outflow from the separation region and its rupturing behavior). As a result, the rated current at which the interruption switch 1 trips passively can be defined. The inertia can also be defined by means of this kind of dimensioning.

Upon an activation of the interruption switch 1 by means of the ignition device 35 or by means of a passive activation, a gas pressure is thus generated on the side of the sabot 25 facing away from the upsetting region 23, as a result of which the sabot is subjected to a corresponding axial force. This force is selected by means of suitable dimensioning of the propellant charge in such a way that the switching tube 9 is plastically deformed in the upsetting region 23, and accordingly the sabot is moved in the direction of the first connection contact 11. The propellant charge is dimensioned in such a way that the motion of the sabot 25 into the end position shown in FIG. 2 takes place.

Immediately after the activation of the propellant charge, the separation region 27 is accordingly ruptured, at least partially. If the rupture does not already occur before the onset of the axial motion of the sabot 25 over the entire circumference of the separation region 27, then a remaining portion of the separation region that is still causing an electrical contact is completely ruptured by the axial motion of the sabot 25.

Depending on the dimensioning of the separation region and the propellant charge, it is also conceivable that the separation region will not initially rupture after the activation but instead the gas pressure is generated also in the annular region surrounding the separation region 27, only through corresponding openings in the wall of the separation region. The tearing open of the separation region 27 can then essentially take place only as a result of the axial force on the sabot 25, which also leads to the axial movement of the sabot.

By a suitable choice of the propellant charge and optionally of the ignition mixture included by it, the rupturing behavior can be further controlled as well. Thus the nitrocellulose powder that generates the combustion temperatures of approximately 1000° C. only tears the separation region open, while thermite, for instance, at combustion temperatures of up to 3400° C., would even additionally melt the material comprising the separation region and gasify it.

Particularly the gas pressure generated by the burnoff can be well controlled by introducing readily gasifiable liquids or solids into the chamber that contains the propellant charge or into which the hot gases generated penetrate. For instance, water in particular, for instance bound in nitrocellulose or in the form of microcapsules, gels, etc. increases the gas pressure considerably. A thus-effected increase in the gas pressure can be even more extreme if the water introduced into the combustion chamber is superheated, in particular as a result of the fact that the highly heated water, when the separation region breaks open, undergoes explosive decompression.

As shown in FIG. 1, the interior of the upsetting region 23 and optionally a channel-like region of the interior of the switching tube 9 as well, in the vicinity of the sabot 25, can be filled with an extinguishing agent 45. It is understood that it is also possible for only a part of the applicable volume to be filled with an extinguishing agent 45. The extinguishing agent may be embodied as liquid, or as a gaseous, gel-like, foamlike, or also multiphase extinguishing agent. A multiphase extinguishing agent could for instance be a liquid with some proportion of gas or a liquid with some proportion of a solid, such as sand. In each case, the extinguishing agent must be of such a nature that upon a reduction in the receiving volume 47 inside the contact unit, which is reduced as a result of the upsetting operation, can be discharged from a discharge opening into the separation region between the separated ends of the separation region 27.

In the embodiment shown in FIG. 1, the extinguishing agent is introduced directly into the receiving volume 47, which encloses a corresponding chamber inside the upsetting region 23 and a discharge channel 49 provided centrally and axially in the sabot 25.

The discharge channel 49 is closed, on its side facing away from the upsetting region 23, by means of a destructible membrane 51. On the axial side facing toward the first connection contact 11, the receiving volume 47 is closed by means of a filler piece 53 which is embodied as a cylindrical part. The cylindrical filler piece 53 is pressed-fitted into the hollow-cylindrical first connection contact 11. The filler piece can likewise comprise metal, such as copper. In addition, a further sealing element 55 can also effect sealing between the axial outer wall of the filler piece 53 and the inner wall of the first connection contact 11.

Thus upon a tripping operation of the interruption switch 1, not only is an electrical disconnection of the separation region 27 of the switching tube 9 or contact unit 5 effected, but as a result of the upsetting operation of the switching tube 9 in the separation region 27, the receiving volume 47 for the extinguishing agent 45 is also reduced, so that the extinguishing agent is discharged through the discharge channel 49 in the sabot 25 in the direction of the stationary, separated end of the separation region 27. The discharging takes place at high pressure, so that a forceful stream of the extinguishing agent 45 is sprayed in the direction of the stationary, separated end of the separation region 27.

As a result of the central discharging of the extinguishing agent in the axis of the switching tube 9 or contact unit 5, the extinguishing agent is discharged, immediately at the onset of the tripping operation (or upon the onset of the axial motion of the sabot 25), precisely into the particular region or volume where an electric arc can form. The electric arc is thus reliably extinguished, or is even prevented from occurring in the first place.

Instead of the receiving volume 47 being at least partially filled with the extinguishing agent 45, it is also possible for the extinguishing agent to be introduced, in a container (not shown), into the receiving volume 47. The container can be embodied in rigid fashion and can be thrust into the receiving volume upon the assembly of the interruption switch 1, before the filler piece 53 is introduced into the first connection contact 11. A rigid container for the extinguishing agent 45 can be embodied for instance as a glass tubule of a shape that is appropriate for the receiving volume 47. The container can also additionally engage in the discharge channel 49 and its face end can be aligned with the discharge opening of the discharge channel 49. The face end of the container can be designed such that it is destroyed by the pressure of the generated gas upon tripping of the interruption switch 1. The destruction can, however, also not be effected until the actual upsetting operation. As a result of the destruction of the shell at least in the region of the face end, it is ensured that the extinguishing agent 45 is forced out through the discharge channel 49 during the upsetting operation.

Instead of being provided in a rigid shell, the extinguishing agent 45 may also be provided in a flexible shell, which is introduced into the receiving volume 47 upon the assembly of the interruption switch 1. The shell is likewise embodied in such a way that it is destroyed by the pressure of the gas and/or by the actual upsetting operation (that is, by mechanical forces), as a result of which the extinguishing agent is released.

Instead of being placed in a single shell, whether flexible or rigid, the extinguishing agent 45 can, it is understood, also be introduced in a plurality of closed shells into the receiving volume 47. The use of microbeads is also possible; each microbead comprises a rigid or flexible shell, such as a plastic, in which a corresponding quantity of the extinguishing agent 45 is provided.

In order to be able to use the entire upsetting operation as much as possible for expelling the extinguishing agent 45, it is advantageous if the entire receiving volume 47 (optionally up to the volume of the discharge channel 49) or the corresponding shells or containers is filled as much as possible with the extinguishing agent.

When containers are used that are large enough that they no longer fit through the discharge channel 49 without having to be destroyed, it is understood that the membrane 51 for sealing off the discharge channel 49 or the discharge opening of the discharge channel 49 can be dispensed with.

Figure 2:
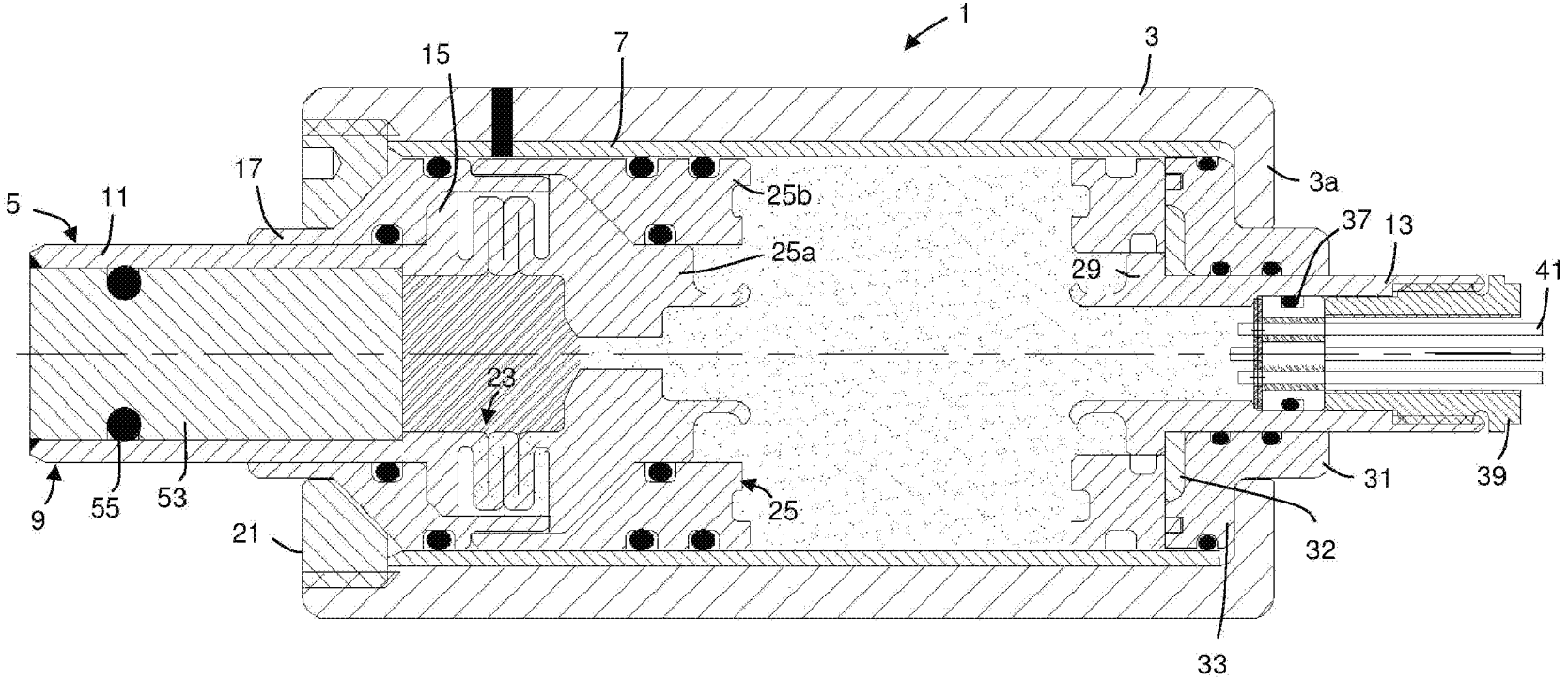
FIG. 2 is a longitudinal section through the embodiment of FIG. 1 in the tripped state.

As can be seen from FIG. 2, which shows the final state of the contact unit 5 after tripping of the interruption switch 1, the upsetting region 23 of the contact unit 5 is preferably embodied such that the wall of the contact tube 9 is folded in meandering fashion in the upsetting region 23. The meandering folding is preferably intended to take place predominantly outside the discharge volume, in order to prevent a folded region from being placed in front of the inlet opening of the discharge channel 49 and preventing the expulsion of the extinguishing agent 45. The folding in a region outside the receiving volume, however, is preferred in any case because of the internal pressure of the extinguishing agent 45 that results in the upsetting of the switching tube 9, although there is no need to make additional provisions for this, such as intentional kinking points or the like. It is understood, however, that the desired fold properties can be generated or optimized by such additional measures. In particular, intentional bending points can be created on the outer and/or inner wall by suitable structural features of the upsetting region. The axial protrusions of the insulator element 17 and of the second sabot part 25*b* that mesh with one another in the final state are also embodied in terms of their axial length such that, during the upsetting operation and in the final state, they prevent the inner wall of the casing 3 from touching the radially outer parts of the folded region of the wall of the switching tube 9. Such touching is associated with damage to the insulation layer 7, if such an insulation layer is provided on the inner wall of the casing 3.

In variants without this kind of insulation layer 7, this prevents a metal casing 3 from being at the same electrical potential as the first connection contact.

Figure 3:
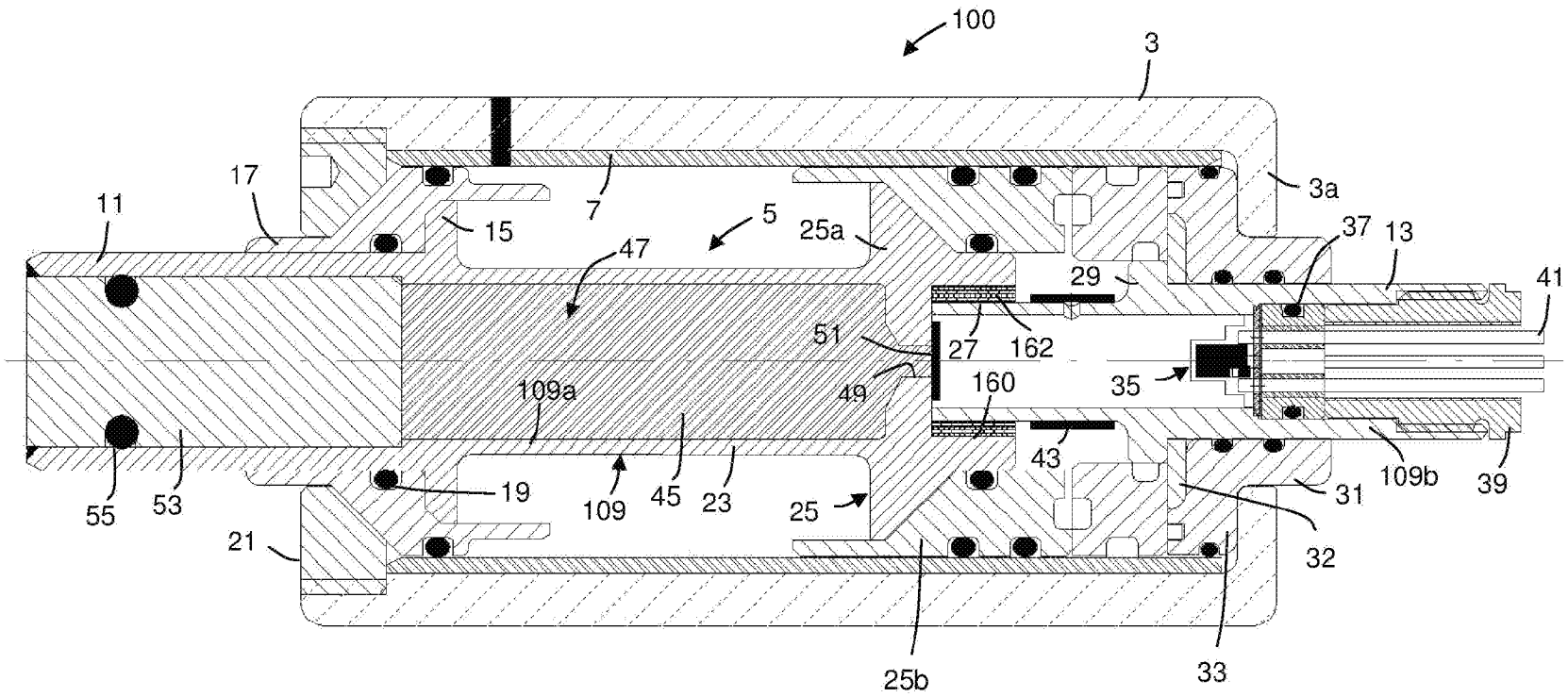
FIG. 3 is a longitudinal section through a second embodiment of an interruption switch of the invention in the initial state.

The further embodiment of an interruption switch 100 shown in FIG. 3 is distinguished from the embodiment of FIGS. 1 and 2 in that a two-piece switching tube 109 is used instead of a one-piece switching tube 9. A first part 109*a* of the switching tube 109 is identical to the corresponding part of the switching tube 9 that includes the first connection contact 11, the flange 15, the upsetting region 23, and the sabot 25. A second part 109*b* of the switching tube 109 includes the separation region 27, which is received, with an end facing toward the sabot 25, in a receiving recess 160 in the face end of the sabot 25 facing away from the upsetting region. The second part 109*b* of the switching tube 109 furthermore includes the flange 29 and the second connection contact 13.

Except for the two-part embodiment of the switching tube 109, the embodiment shown in FIG. 3 is practically identical to the embodiment in FIGS. 1 and 2. Equivalent parts, regions and components are therefore provided with identical reference numerals.

In principle, the electrical contact required between the parts 109*a* and 109*b* of the switching tube 109 can also be established by simply inserting or press-fitting the end region of the separation region 27 into the receiving recess 116 of the sabot 25. However, then there is the risk that because of corrosion, mechanical vibration, or other factors, a permanent electrical contact with the requisite quality cannot be established or maintained.

FIG. 3 therefore shows a special means for producing a long-term-stable and secure electrical contact between the two parts 109*a* and 190*b* of the switching tube 109. This involves a contact spring insert, which is provided on the axial inner wall of the receiving recess 116. The contact spring insert can have axial grooves, for instance, in each of which a contact spring is contained that rises out radially inward via the axial inner wall of the receiving recess 116 or of the contact spring insert 162. The contact springs are resiliently compressed radially outward as the front region of the separation region 27 is inserted into the receiving recess 116. As a result of the many electrically conductive, resilient elements, an electrical contact that is stable and secure over the long term, by way of which even high currents can be carried, is therefore ensured.

The basic mode of operation of the interruption switch 100 of FIG. 3 is largely similar to the function described above of the embodiment of FIGS. 1 and 2. However, it differs in that the separation region 27 is no longer destroyed; only the front end thereof, that is, the end of the separation region 27 facing toward the sabot 25, is pulled out of the receiving recess 116 of the sabot 25.

Figure 4:
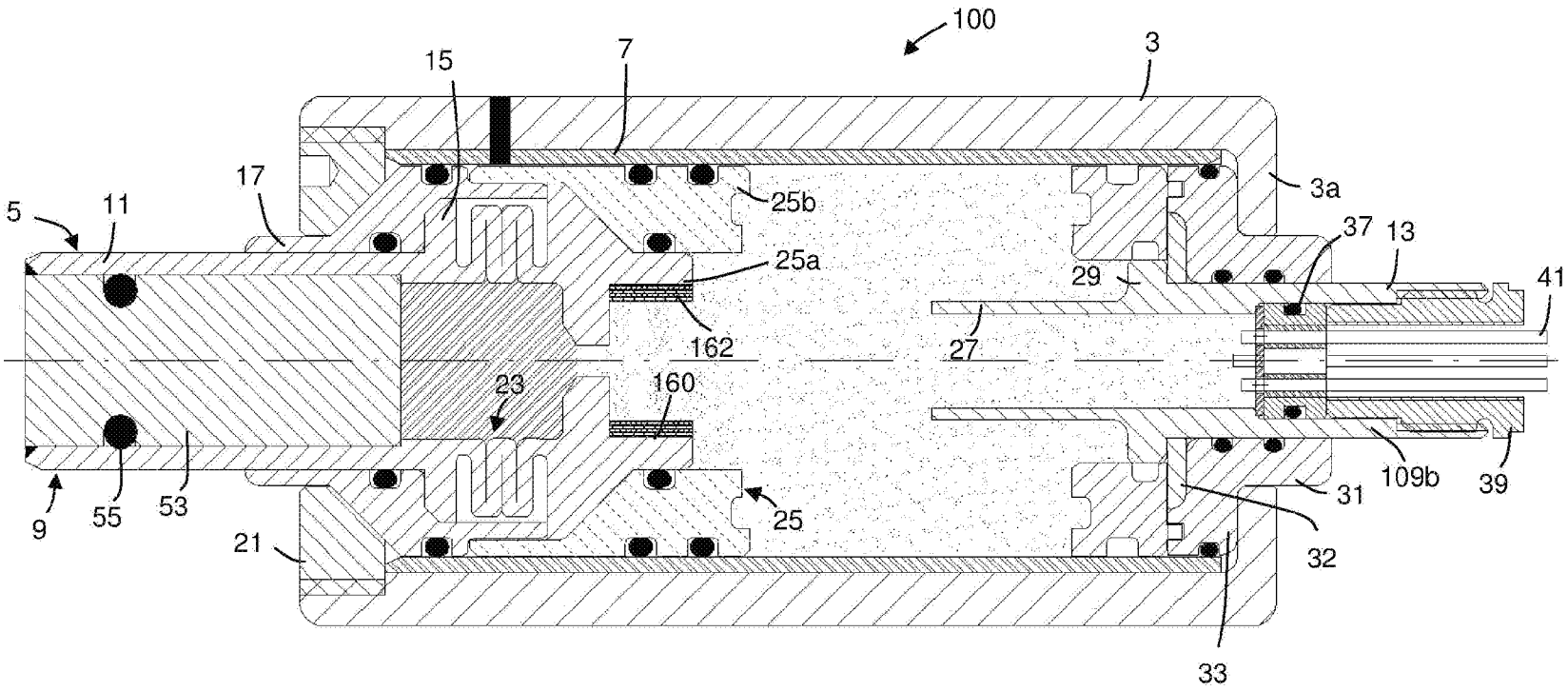
FIG. 4 is a longitudinal section through the embodiment of FIG. 2 of in the tripped state.

The final state of the interruption switch 100, once tripping has taken place, is shown in FIG. 4. To ensure that the pressure can immediately be exerted on the entire end face of the sabot 25 after the activation of the gas-generating material of the propellant charge, in the embodiment of FIGS. 3 and 4 the separation region must have openings in the wall of the switching tube 109 or of the second part 109*b* of the switching tube 109.

In this variant as well, the discharge channel 49 for the extinguishing agent 45 is meant to be designed such that the stream of extinguishing agent 45 is aimed at the stationary end of the second part 109*b* of the switching tube 109. Since the electric arc will form between the annular wall, or the face end of the annular wall, of the stationary part of the separation region 27 and an opposite part of the end face of the first part 109*a* of the switching tube 109, the stream of extinguishing agent 45 should be designed such that it is aimed at the end face of the wall of the separation region 27.

As explained above, the shape of the stream of extinguishing agent 45 can be achieved by means of suitable design of the discharge channel 49, preferably by means of a suitable nozzle-like design, as a result of which the diameter of the stream of extinguishing agent can be varied depending on the distance from the discharge opening.

Figure 5:
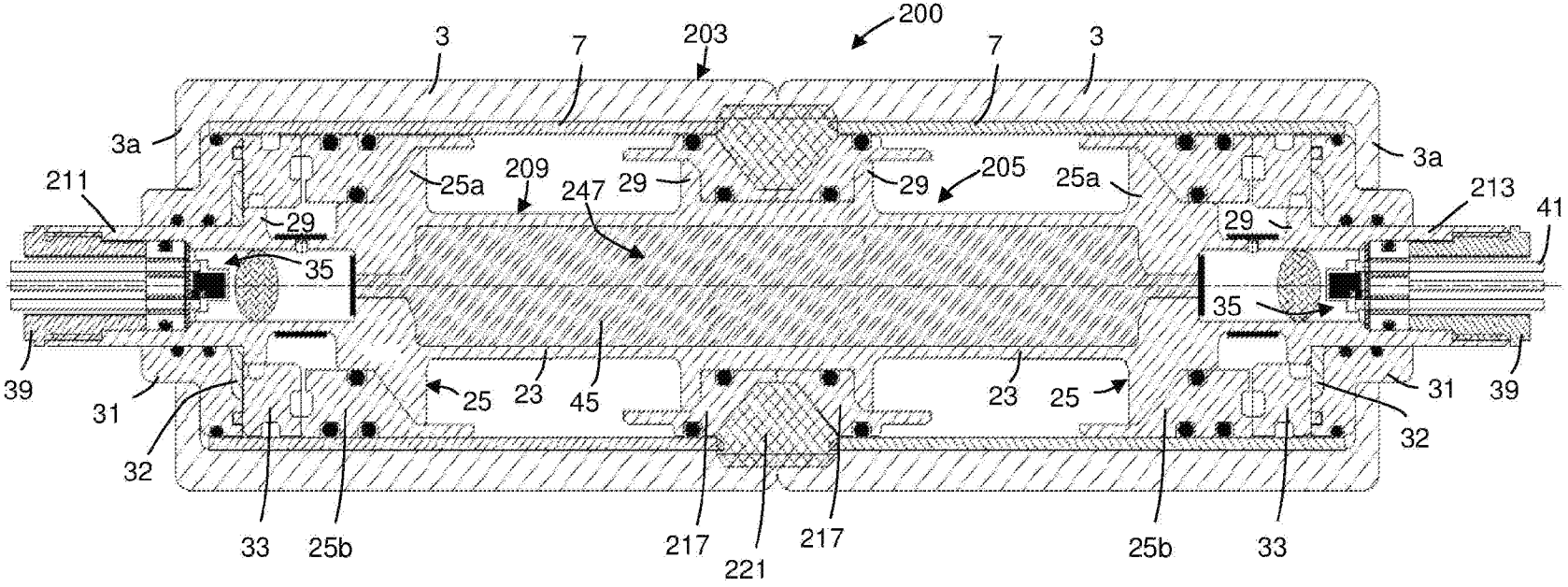
FIG. 5 is a longitudinal section through a third embodiment of an interruption switch of the invention in the form of a multiple interruption switch in the initial state.

FIG. 5 shows a further embodiment of an interruption switch 200, which has a switching tube 209 or a contact unit 205, which makes an essentially simultaneous dual separation of the current path at two serial interruption points possible.

The interruption switch 200 has a casing 203, which can be composed of two casings 3 of the embodiments of FIGS. 1 and 2 and FIGS. 3 and 4, respectively. The two casing parts 3 are oriented axially counter to one another in such a way that the face ends into which, in the variant of FIGS. 1 and 2, the locking nut 21 is screwed, face one another. Instead of the locking nut 21, a connecting element 221 can be screwed in here, or the casing parts 3 can be screwed onto the connecting element 221.

Instead of a switching tube with a single separation region, in the variant of FIG. 5 a switching tube 209 with two separation regions 27 is provided. The switching tube 209 is essentially equivalent to two switching tubes 9 of FIG. 1, which are joined in one piece with one another by a shortened first connection contact 11. Instead of a contact tube 209 embodied in one piece, as is used in the embodiment of FIG. 5, it is understood that a two-part contact tube can also be used, which is produced from two contact tubes 9 of FIG. 1. For that purpose, a first connection contact 11 that might be embodied as too long can be shortened, for instance sawed off. For connecting the two contact tubes, a filler piece 53 can be used that is embodied as long enough that it can be press-fitted or screwed in by one end in each case into the respective (shortened) first connection contact 11 of the respective switching tube 9.

In the interruption switch 200 of FIG. 5, a receiving volume 247 for the extinguishing agent 45 is provided, which is embodied in the entire first and second upsetting regions 23 as well as in the interior, located between them, of the switching tube 209, or in other words in the partial vicinity of the switching tube 209, which is surrounded by the connecting element 221 and corresponding insulator elements 217.

The regions of the interruption switch 200 that are located on the outside are each identical to the partial region, shown on the right in FIG. 1, of the switch 1, both in terms of structure and in terms of the components and functionality. Thus reference can be made to the corresponding explanations above in conjunction with FIGS. 1 and 2.

On each of both sides, the switch 200 has a respective connection contact 211 and 213, and an ignition device 35 is provided in these contacts.

Although a passive activation by means of heating the separation regions 27 is provided in the embodiment shown in FIG. 5, it is nevertheless not ensured that an essentially simultaneous ignition of the propellant charges is guaranteed in every case, unless special additional provisions are made. That kind of simultaneous activation is necessary, however, in order to achieve the desired simultaneous separation of the current path at two serially connected points. By means of the simultaneous interruption, during the shutoff operation, via each length that is to be separated or that is already separated, only half the voltage arrives as a voltage drop, which is applied to the connection contacts 211, 213. An electrically triggerable activation makes this kind of simultaneous shutoff easier.

Figure 6:
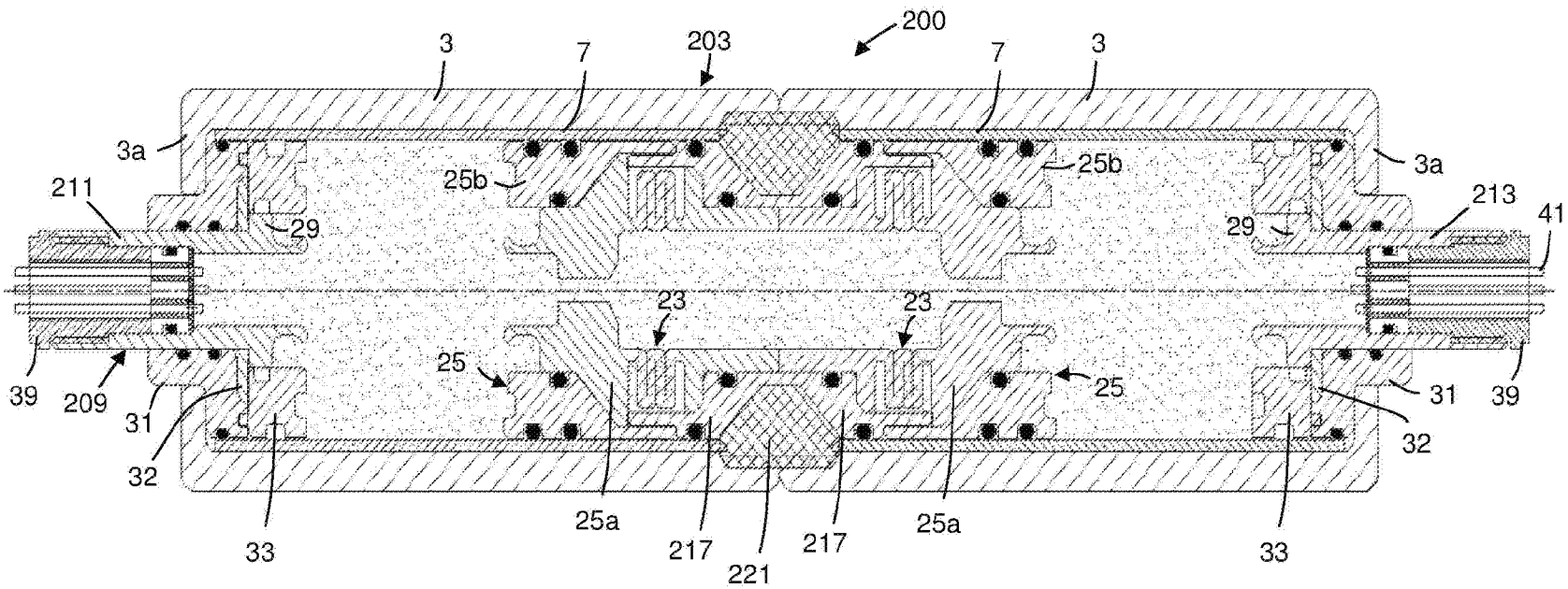
FIG. 6 is a longitudinal section through the embodiment of FIG. 5 in the tripped state.

Otherwise, the tripping operation of the embodiment of FIG. 5 is essentially equivalent to the embodiment of FIG. 1. As shown in FIG. 6, upon an activation of the ignition devices 35, the respective sabot 25 is subjected to pressure and moved in the direction of the center plane E (plane of symmetry of the interruption switch 200, the plane being located perpendicular to the longitudinal axis). As a result, the two upsetting regions 23 in turn act like a pump, with which the extinguishing agent 45 emerges through the two discharge channels 49 and fills up the chamber between the two separated ends of the separation region 27.

Figure 7:
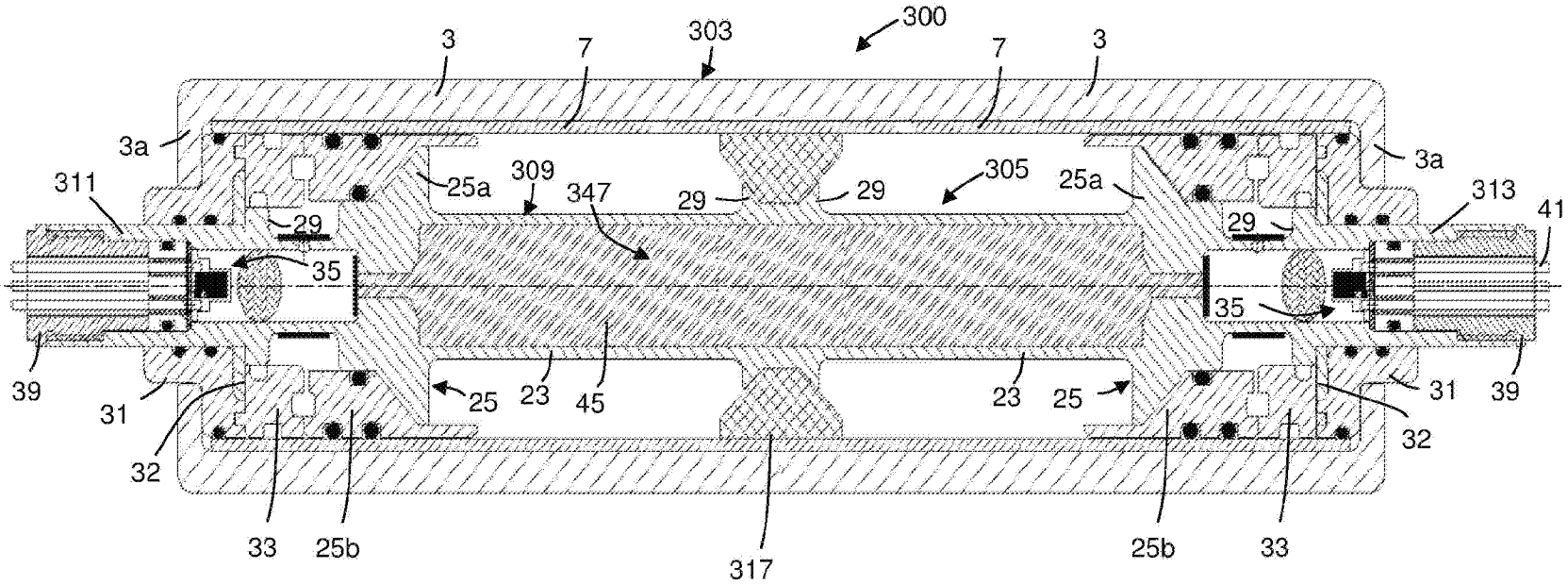
FIG. 7 is a longitudinal section through a further embodiment of a multiple interruption switch in the initial state.

The variant of an interruption switch 300 shown in FIG. 7 is also maximally suitable for this function. The essential distinction between the interruption switch 300 of FIG. 7 and the interruption switch 200 of FIG. 5 is that the interruption switch 300 has a casing 303 that is embodied in one piece. The switch 309, which defines connection contacts 311, 313, is likewise embodied in one piece; instead of the connecting element 221 and the insulator elements 217 of the embodiment of FIG. 5, a stabilizer element 317 is provided. The stabilizer element 317 likewise comprises an insulating material and essentially serves to fix the switching tube radially and axially in the casing. The somewhat differently designed flanges 29 of the switching tube 309 here define a circumferential groove, which is engaged by the annular stabilizer element 317 with its radially inner region.

Axial protrusions, each extending outward in the direction of the upsetting regions 23 and cooperating with the protrusions of the sabots 25, are dispensed with in the embodiment shown in FIG. 7.

Also in the embodiment of FIG. 7, a receiving volume for the extinguishing agent 45 is provided which extends in the entire interior of the switching tube 309 between the discharge openings of the two discharge channels 49. It is understood that here again, instead of a single receiving volume 47, a first receiving volume can be provided in the left upsetting region 23, and a second receiving volume can be provided in the right upsetting region 23.

As described above in conjunction with the embodiment of FIGS. 1 and 2, the extinguishing agent can be introduced into the receiving volume either as such or enclosed The mode of operation of the embodiment of FIG. 7 is practically identical to the mode of operation of the embodiment of FIG. 5. The applicable end state after the termination of the switching operation is shown in FIG. 8.

Figure 8:
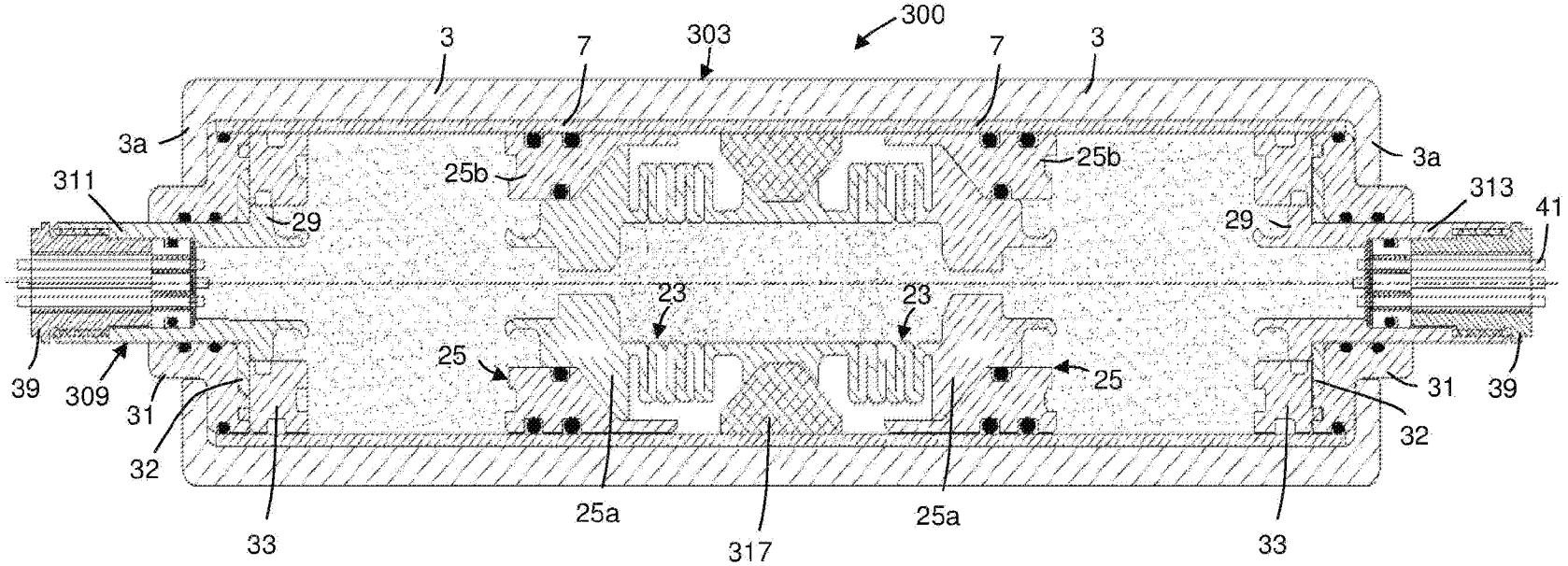
FIG. 8 is a longitudinal section through the embodiment in FIG. 7 in the tripped state.

It is understood that in the dual interruption switches 200 and 300 of FIGS. 5 and 6 and of FIGS. 7 and 8, respectively, a multi-part switching tube on the principle of the embodiment in FIGS. 3 and 4 can also be employed. For this purpose, it is necessary only that the region of the switching tube 209 and 309, on the one hand, and the respective sabot and the respective separation region on the other, each shown on the outside in FIGS. 5 and 6 on the one hand and FIGS. 7 and 8 on the other, are embodied as described in conjunction with the embodiment of FIGS. 3 and 4. The end region of the respective separation region then engages in the respective receiving recess of the sabot and establishes an electrical contact between the parts of the switching tube 209 and 309, respectively. Regarding the function and the shutoff operation, reference may be made to the above discussions in conjunction with the embodiment of FIGS. 3 and 4.

In all the variants of the invention, it is attained that as a consequence of the sabot that is moved upon a switching operation, an upsetting region of the contact unit 5 adjoining the sabot is deformed in such a way that a receiving volume located in it for the extinguishing agent is reduced in size, as a result of which the extinguishing agent enters through at least one discharge opening into the chamber between the separated parts of the separation region and prevents the occurrence of an electric arc between these two ends, or extinguishes an electric arc that has already occurred.

LIST OF REFERENCE NUMERALS

1 Interruption switch
3 Casing
5 Contact element
7 Insulation layer
9 Switching tube
11 First connection contact
13 Second connection contact
15 Flange
17 Insulator element
19 Sealing element (O-ring)
21 Locking nut
23 Upsetting region
25 Sabot
25*a* First sabot
25*b* Second sabot
27 Separation region
29 Flange
31 Insulator element
33 Filler piece
35 Ignition device
37 Sealing element
39 Locking element
41 Electrical connection lines
43 Ignition mixture
45 Extinguishing agent
47 Receiving volume
49 Discharge channel
51 Membrane
53 Filler piece
55 Sealing element
100 Interruption switch
109 Switching tube
109*a* First part of the switching tube 109
109*b* Second part of the switching tube 109
160 Receiving recess
162 Contact spring insert
200 Interruption switch
203 Casing
205 Contact unit
209 Switching tube
211 Connection contact
213 Connection contact
217 Insulation layer
221 Connecting element
247 receiving volume
300 Interruption switch
303 Casing
309 Switch
311 Connection contact
313 Connection contact
317 Stabilizer element

The invention claimed is:

1. An electrical interruption switch, (a) comprising a casing, which surrounds a contact unit defining a current path through the interruption switch and (b) comprising a propellant charge, which includes a gas-generating activatable material, (c) wherein the contact unit comprises a first and a second connection contact, an upsetting region, a separation region, and a sabot, (d) and the propellant charge and the contact unit are embodied in such a way i. that a current to be interrupted can be supplied thereto via the first connection contact and discharged therefrom via the second connection contact, and ii. that upon an ignition of the propellant charge, the sabot is subjected to a gas pressure, generated by the gas-generating activatable material, in such a way that the sabot in the casing moves in a movement direction from a starting position to an end position and in an operation the upsetting region is plastically deformed, wherein the separation region is separated completely, and in the end position of the sabot, an insulation distance between separated ends of the separation region is achieved, wherein (e) an extinguishing agent is provided in such a way that as a result of a motion of the sabot and/or of an upsetting operation of the upsetting region, a volume for receiving the extinguishing agent is reduced such that the extinguishing agent is injected through at least one discharge channel, which connects the volume for receiving the extinguishing agent to a chamber in which the separation region is located, for extinguishing or preventing an occurrence of an electric arc between the separated ends of the separation region.

2. The electrical interruption switch of claim 1, wherein the volume for receiving the extinguishing agent is provided inside the upsetting region.

3. The electrical interruption switch of claim 1, wherein the upsetting region is designed with regard to material and geometry such that a wall of the upsetting region is folded as a consequence of an upsetting motion.

4. The electrical interruption switch of claim 2, wherein the upsetting region is embodied hollow-cylindrically and annularly in cross section.

5. The electrical interruption switch of claim 2, wherein the extinguishing agent is provided in at least one closed, flexible shell inside the upsetting region, which shell is destructible by the upsetting operation.

6. The electrical interruption switch of claim 2, wherein the at least one discharge channel is embodied in nozzle-like fashion.

7. The electrical interruption switch of claim 2, wherein the at least one discharge channel is closed by a membrane that is destructible during a tripping operation of the interruption switch.

8. The electrical interruption switch of claim 2, wherein one or more discharge channels are provided in the sabot in such a way that one or more discharge openings of the discharge channels are embodied in a vicinity of a cross section of the separation region that adjoins the sabot, at least in an unseparated state.

9. The electrical interruption switch of claim 1, wherein the contact unit has a rectilinear longitudinal axis, along which the sabot is displaceable; that the separation region is provided adjoining the sabot and located in the longitudinal axis; and that a discharge opening is located in the longitudinal axis.

10. The electrical interruption switch of claim 1, wherein the sabot is embodied in two parts, wherein a second sabot comprising an insulating material surrounds a first sabot part that is solidly connected to or embodied in one piece with the contact unit.

11. The electrical interruption switch of claim 1, wherein the separation region and the propellant charge are embodied such (a) that the separation region, upon an ignition of the propellant charge, is ruptured or at least partly ruptured and is completely separated by means of a displacement motion of the sabot, or (b) that the separation region, upon an ignition of the propellant charge, two nondestructible separable parts of the separation region are pushed apart by a displacement motion of the sabot.

12. The electrical interruption switch of claim 1, wherein the contact unit has at least two partial contact units, which each have an upsetting region, a separation region, and a sabot, (a) wherein the partial contact units are each embodied such i. that upon an ignition of the propellant charge, each sabot is subjected in such a way to a gas pressure generated by the gas-generating activatable material that the applicable sabot in the casing moves in a movement direction from a starting position into an end position and in an operation the associated upsetting region is plastically deformed, wherein the applicable separation region is completely separated, and in the end position of the applicable separation region, an insulation spacing is achieved between the separated ends of the applicable separation region; and ii. that the extinguishing agent is provided such that as a result of the motion of one or more sabots or of all the sabots and/or by the upsetting operation of one or more or all of the upsetting regions, the volume for receiving the extinguishing agent is reduced such that the extinguishing agent is injected in each case through at least one discharge channel that connects the volume for receiving the extinguishing agent to the chamber in which the separation region is located, for extinguishing or preventing the occurrence of an electric arc between the separated ends of the applicable separation region.

13. The electrical interruption switch of claim 12, wherein two partial contact units are provided, the contact units and the casing being embodied mirror-symmetrically relative to a center plane.

14. The electrical interruption switch of claim 13, wherein the partial contact units are embodied such that the two upsetting regions are oriented toward one another; and that a common volume is provided for receiving the extinguishing agent inside the upsetting region.

15. The electrical interruption switch of claim 12, wherein each partial contact unit is assigned a separate partial propellant charge; and that a triggerable device is provided for an active and essentially simultaneous ignition of the separate partial propellant charges.

16. The electrical interruption switch of claim 3, wherein the wall of the upsetting region is folded in a meandering fashion.

17. The electrical interruption switch of claim 7, wherein the at least one discharge channel is in a vicinity of at least one discharge opening.

18. The electrical interruption switch of claim 10, wherein the second sabot part is sealed off from the first sabot part and from the casing.

19. The electrical interruption switch of claim 13, wherein the separation regions and the sabots are provided outside the upsetting regions located between them.

* * * * *